US011399647B2

(12) United States Patent
Heimowitz-Richter et al.

(10) Patent No.: US 11,399,647 B2
(45) Date of Patent: Aug. 2, 2022

(54) DEVICE FOR HANDLING GARMENTS

(71) Applicants: Tamar Rachel Heimowitz-Richter, Shoham (IL); Rafael Richter, Shoham (IL)

(72) Inventors: Tamar Rachel Heimowitz-Richter, Shoham (IL); Rafael Richter, Shoham (IL)

( * ) Notice: Subject to any disclaimer, the term of this patent is extended or adjusted under 35 U.S.C. 154(b) by 179 days.

(21) Appl. No.: 16/490,341

(22) PCT Filed: Mar. 7, 2018

(86) PCT No.: PCT/IL2018/050257
§ 371 (c)(1),
(2) Date: Aug. 30, 2019

(87) PCT Pub. No.: WO2018/167772
PCT Pub. Date: Sep. 20, 2018

(65) Prior Publication Data

US 2020/0069098 A1 Mar. 5, 2020

Related U.S. Application Data

(60) Provisional application No. 62/471,426, filed on Mar. 15, 2017.

(51) Int. Cl.
*A47G 25/48* (2006.01)
*D06F 95/00* (2006.01)

(52) U.S. Cl.
CPC ..... *A47G 25/48* (2013.01); *D06F 95/008* (2013.01)

(58) Field of Classification Search
CPC ..... A47G 25/48–52; A47G 25/481–487
USPC ..... D32/60, 61
See application file for complete search history.

(56) References Cited

U.S. PATENT DOCUMENTS 250,268 A * 11/1881 Loomis ..... A47G 25/52 223/91
803,464 A * 10/1905 Beck ..... D32/61
2,064,591 A * 12/1936 Toney ..... D06F 55/00 24/543
2,111,772 A * 3/1938 Guillot ..... A47G 25/1414 223/88

(Continued)

FOREIGN PATENT DOCUMENTS

CN 201379390 Y 1/2010
CN 104643857 A 5/2015

(Continued)

OTHER PUBLICATIONS

International Search Report and Written Opinion from International Application No. PCT/IL2018/050257 dated Jun. 11, 2018.

(Continued)

*Primary Examiner* — Ismael Izaguirre
(74) *Attorney, Agent, or Firm* — The Roy Gross Law Firm, LLC; Roy Gross

(57) ABSTRACT

A garment handling device is disclosed, comprising at least one elongate garment receiving recess extending between two neighboring elongate members made of rigid material and articulated to one another at one end. The garment handling device is configured with a garment opening at the respective opposite end of the neighboring elongated members.

11 Claims, 6 Drawing Sheets

(56) References Cited

U.S. PATENT DOCUMENTS

| | | | | | |
|---|---|---|---|---|---|
| 2,138,914 | A | * | 12/1938 | Frey | A47G 25/746 211/120 |
| 2,171,680 | A | * | 9/1939 | Baugh | A47G 25/48 223/96 |
| 2,517,211 | A | * | 8/1950 | Jones | A47G 25/52 223/95 |
| 2,626,439 | A | * | 1/1953 | Mack, Sr. | D06F 55/00 24/559 |
| 2,723,786 | A | * | 11/1955 | Martin | A47G 25/52 223/91 |
| 2,900,118 | A | * | 8/1959 | Simon | A47G 25/487 223/96 |
| 3,054,538 | A | * | 9/1962 | Rubin | A47G 25/24 223/88 |
| 3,603,491 | A | * | 9/1971 | Weight | A47G 25/487 223/96 |
| 4,959,892 | A | * | 10/1990 | Wang | A44B 99/00 24/489 |
| 5,234,139 | A | | 8/1993 | Korenstein | |
| D353,245 | S | * | 12/1994 | Tucker | D32/61 |
| 5,440,791 | A | | 8/1995 | Guio | |
| D384,459 | S | | 9/1997 | Eisenman | |
| 5,671,876 | A | | 9/1997 | Gardner | |
| D467,050 | S | * | 12/2002 | Russo | A47G 25/487 D32/64 |
| 7,225,507 | B2 | | 6/2007 | Anderson et al. | |
| 7,631,753 | B1 | | 12/2009 | Temmel | |
| 2005/0144765 | A1 | | 7/2005 | Anderson et al. | |
| 2006/0143780 | A1 | | 7/2006 | Brian | |
| 2014/0097214 | A1 | * | 4/2014 | Schreckenhofer | D06F 95/008 223/85 |
| 2014/0137426 | A1 | | 5/2014 | Woodson | |
| 2016/0153587 | A1 | * | 6/2016 | Smith | H02G 3/30 29/515 |

FOREIGN PATENT DOCUMENTS

| | | | |
|---|---|---|---|
| CN | 104665515 | A | 6/2015 |
| CN | 204394126 | U | 6/2015 |
| CN | 204950422 | U | 1/2016 |
| CN | 105411334 | A | 3/2016 |
| DE | 20203941 | U1 | 10/2002 |
| DE | 202004003726 | U1 | 7/2004 |
| DE | 202007004386 | U1 | 6/2007 |
| GB | 2432879 | B | 7/2008 |
| JP | 2000225008 | A | 8/2000 |

OTHER PUBLICATIONS

U.S. Appl. No. 62/471,426, filed Mar. 15, 2017.

* cited by examiner

DEVICE FOR HANDLING GARMENTS

TECHNOLOGICAL FIELD

The present disclosure is directed to a device for handling garments during a laundering cycle.

Hereinafter in the specification and claims the term 'garment' denotes any one or more article of clothing, such as legwear, etc.

The term 'laundering cycle' as used hereinafter in the specification and claims denotes any one or more steps during the process of treating a garment from prewashing, i.e. sorting and storing of the garments prewashing, through washing, drying (tumble drying, line-drying, or any other drying method) and storing/displaying, whether a domestic or industrial process.

BACKGROUND ART

References considered to be relevant as background to the presently disclosed subject matter are listed below:

U.S. Pat. No. 5,671,876
U.S. Pat. No. 7,225,507
U.S. Pat. No. 7,631,753
USD384,459

Acknowledgement of the above references herein is not to be inferred as meaning that these are in any way relevant to the patentability of the presently disclosed subject matter.

BACKGROUND

Small garments often tend to get lost or mispaired during a laundering cycle. In particular small clothes articles which are typically paired, such as socks and the like.

A variety of pairing and laundering accessories are known in the art, many of which are suited for pairing/attaching only one sock to another sock.

U.S. Pat. No. 5,671,876 disclose a sock organizer is made from molded polycarbonate plastic from a die. The sock organizer is suitable for use in the water and heat in a washing machine. The sock organizer includes a clamp like device with a plurality of parallel finger elements to grasp socks therebetween. The clamp has two sides that are shut to secure the socks in place. The sock organizer may be placed directly from the washer to the dryer to keep the socks organized during the laundry process.

U.S. Pat. No. 7,225,507 discloses a clip device that will separately hold each of a pair of clothing items, one to each side of the unit, during a mechanical laundry activity or while in storage. The purpose of the product is to prevent loss of either of a pair of small clothing items such as a mated pair of socks. The clip device has a left and a right separately hinged top section, with the hinges near the middle, which permits each top section to be separately raised for the placing of the clothing item. Each top section then is snapped closed using a separate lock and release mechanism on each side. Each side of the clip device has cone shaped grippers protruding in an alternating pattern from both the top and bottom sections to hold the item securely during the mechanical washing and drying of socks.

U.S. Pat. No. 7,631,753 discloses an apparatus includes a receptacle that has monolithically formed and bifurcated front and rear portions. The front and rear portions include an open top section and defines a cavity therein. The front portion has a linear slot formed medially therein and extending parallel downwardly along a longitudinal axis of the receptacle. Color-coded sock clips are included for holding paired socks together. The clips are formed from waterproof and heat resistant material such that the socks secured thereto can be laundered in conventional washing and drying machines. The clips are positional along the slot so that the clips and associated socks are vertically stacked in the receptacle. Fastening members are positional through the rear portion and into a wall surface for supporting the receptacle at an elevated position.

USD384,459 is directed to the ornamental design of a clip for use in laundering socks.

General Description

According to the present disclosure there is provided a device for handling of garments during a laundering cycle, i.e. a device configured for holding at least one garment and retaining it during sorting/storing, pre/post laundering, laundering and drying steps.

The device according to the disclosure comprises at least one elongate garment receiving recess extending between two neighboring elongate members made of rigid material and articulated to one another at one end, and configured with a garment opening at their respective opposite end.

According to a configuration of the disclosure, the device is further configured with a closure mechanism for closing the opening of the garment receiving path, said device configured between an open position wherein said garment opening is open, and a closed position wherein said garment opening is closed.

The arrangement is such that at the so-called open position, the garment opening is open, thus facilitating introducing/removal of one or more garments into the garment receiving recess, whilst at the so-called closed position the garment opening is closed.

The arrangement is such that even at the open position of the device, the one or more garments are securely retained within garment receiving recesses and the device can be placed or suspended with the one or more garments disposed and retained within the garment receiving recesses, whilst for a laundering/drying procedure it is required to close the closure mechanism, thus to prevent garments from detaching from the device.

The arrangement is further such that the elongate members of the device are rigid, however upon closing the closure mechanism the respective open end of the elongate members deform so as to decrease the garment receiving recess, thereby clamp therebetween one or more garments introduced therein.

According to one particular design, the device is U-like shaped and is configured with a single garment receiving recess extending between a first elongate member and a second elongate member. According to another particular design, the device has an S-like shape configured with two garment receiving recesses, having a garment opening opposite ends. According to yet an example, the device has a W-like shape and is accordingly configured with two or three garment receiving recesses, two of which having a garment opening facing in the same direction and one at an opposite direction.

Thus, the garment handling device according to the present disclosure serves throughout the handling of the garments, i.e. from an early stage wherein garments are introduced into the garment receiving recess through the open garment opening, optionally sorted (i.e. pairing of mating articles such as socks and the like), than the device is closed and introduced into a washing machine, after which it follows into a drying session (e.g. in a tumble dryer or suspended over a laundry line, or any other hanging arrangement), and further, the device can serve for retaining the garments and displaying them, e.g. in a drawer or at any storage/display location, either laying, suspended or self-standing.

Any one or more of the following features, designs and configurations can be applied in a garment handling device, according to the present disclosure, separately or in various combinations thereof:

- The garment handling device can be made of durable material resistant to laundering agents, i.e. water and detergents;
- The garment handling device can be made of, or be coated with at least a layer of UV repelling material;
- The garment handling device can be made of heat durable material, suited for use in washing machines, sun/line drying and tumble drying. According to a particular example the device is heat resistant to withstand at least 70° C.;
- The device can be made of any polymer-based material;
- The device can be made of molded plastic material;
- The device can be made in 3D printing technology;
- The device can be a single-mold plastic material or a multi-component molded material;
- The device can be configured with smooth edges and corners, to avoid fabric damage;
- The elongate members can be configured as rods;
- The elongate members can be configured as flat members;
- One or both of flat elongate members can be configured with one or more through going openings, for improving drying of garments received within the garment receiving recess and increasing contact with washing liquids;
- The device is configured for hanging at least at the open position;
- The device can be suspended from a wall hook, from a laundry line/rod, from a suction cup, a cupboard door hook, door handle, door knob, etc.;
- The device can be extended by articulating thereto a like device. Such articulation can be configured by a coupler element, by a bayonet coupling, etc.;
- The closure mechanism can be a clamping band extending over the neighboring elongate members and tending to decrease the space of the at least one elongate garment receiving recess;
- A clamping band of the closure mechanism can be fixedly or removably attached to either one of the elongate members. Said clamping band can serve or hanging the device at the open position;
- The closure mechanism can be configured at any location of the elongate members;
- The closure mechanism can be configured as a snapping clamp, integral with, or detachable from the device;
- According to one configuration, the device can be suspended, wherein at the suspended position the garment opening is open;
- The device can be a solid, uniform unit, wherein the elongate members are continuous with one another;
- The hanging device can be integral with, or separate from, the elongate members;
- The closure mechanism can be integral with, or separate from, the elongate members;
- The closure mechanism can be an elastic band configured for embracing the elongate members;
- The elongate members can be integrally articulated to one another through a living hinge, wherein the elongate members can be pivotable about said living hinge to allow complete access to the garment receiving recesses;
- The elongate members can be of equal length, or not;
- The garment receiving recesses can be configured with a garment retention arrangement. A garment retention arrangement can be one or more bulges or ribs projecting inwards from an inside face of the one or both of respective elongate members;
- The elongate members of garment handling device can be uniformly and integrally formed with one another and with the closure mechanism;
- At the open position, some or all of the elongate members can extend parallel to one another;
- The device can be configured for placing over a flat surface at an erect position; Though the elongate members are made of rigid material, they can be configured with a certain degree of flexibility, so as to deform when a closing member is applied thereover, or at the presence of one or more garments within the garment receiving recess, so as to impart clamping force thereover.

BRIEF DESCRIPTION OF THE DRAWINGS

In order to better understand the subject matter that is disclosed herein and to exemplify how it may be carried out in practice, embodiments will now be described, by way of non-limiting examples only, with reference to the accompanying drawings, in which.

DETAILED DESCRIPTION OF EMBODIMENTS

Figure 1B:
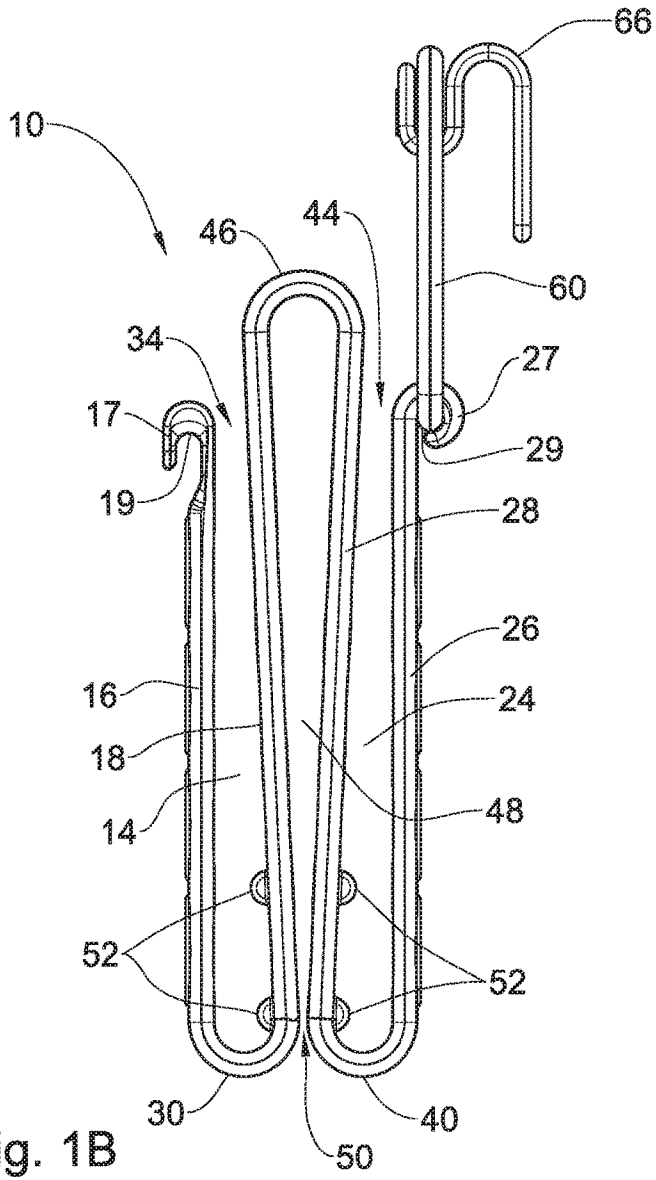
FIG. 1B is a side view of FIG. 1A.
Figure 1A:
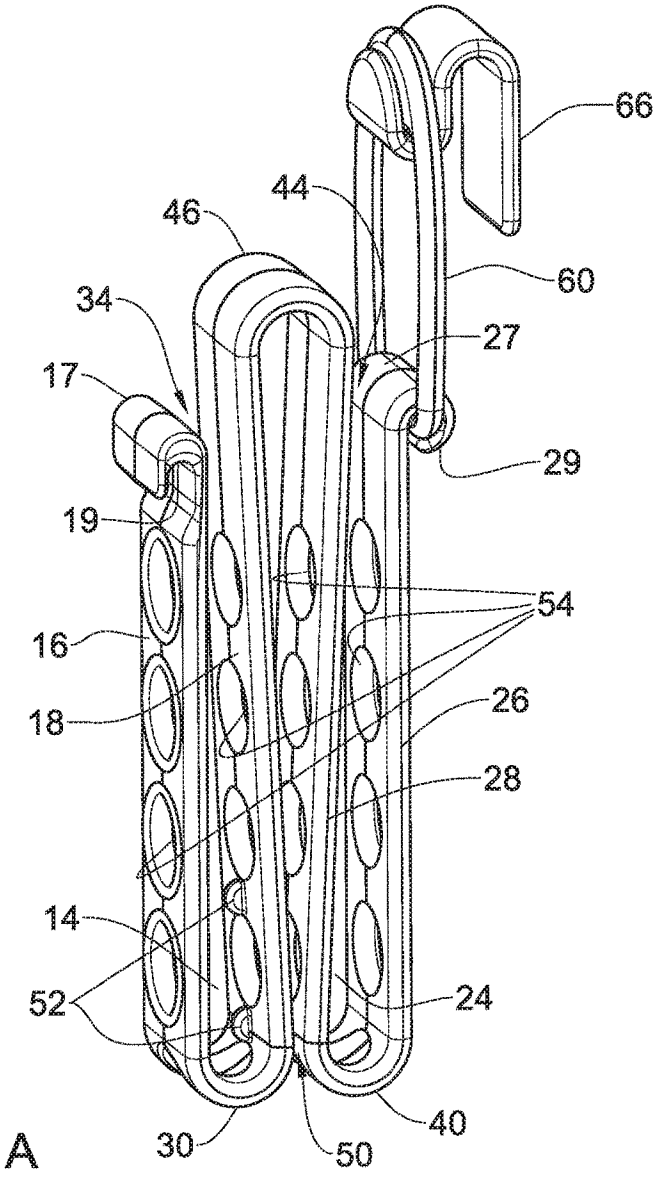
FIG. 1A is a top perspective view of a garment handling device according to an example of the disclosure, the device illustrated suspended at an open position.

Attention is first directed to FIGS. 1A and 1B of the drawings, illustrating a garment handling device according to an example of the present disclosure, generally designated 10. The device 10 is made of a uniform, rigid plastic material, and generally has an open W-like shape.

The device comprises a first elongate garment receiving recess 14 extending between a first external elongate member 16 and a neighboring first inside elongate member 18, and a second elongate garment receiving recess 24 extending between a second external elongate member 26 and a neighboring second inside elongate member 28, wherein the first external elongate member 16 and the neighboring first inside elongate member 18 continuously extend at their respective bottom end 30 and are configured with a first garment opening 34 at their respective opposite end. Likewise, the second external elongate member 26 and the second inside elongate member 28 continuously extend at their respective bottom end 40 and are configured with a second garment opening 44 at their respective opposite end.

The first inside elongate member 18 and the second inside elongate member 28 continuously extend at their respective common top end 46 (extending above the free end 17 of the first external elongate member 16 and the free end 27 of the second external elongate member 26), giving rise to an optional elongate garment receiving recess 48 configured with a bottom facing garment opening 50.

As can further be seen in the drawings, the first garment receiving recess 14 and the second garment receiving recess 24 are each configured with several garment retention projections, in the form of bulges 52 extending from a face of the inside elongate members 18, 28 and projecting into the garment receiving recess 14, 24. The central garment receiving recess 48 illustrated in the drawings is free of retention projections, though these can be configured within said central garment receiving recess 48 as well. The garment retention projections increase grab of any garments received within the garment receiving recess 14, 24, so as to retain them and prevent them from displacing when the device 10 is at the open position.

The elongate members 16, 18, 26 and 28 are flat, and are each configured with several openings 54, provided for increasing air flow and improving drying of any garments accommodated within the garment receiving recesses, and likewise improve penetration of washing liquids. It is appreciated that other forms and shapes of openings can be configured, and can be differently distributed over the elongate members (not shown).

Figure 2:
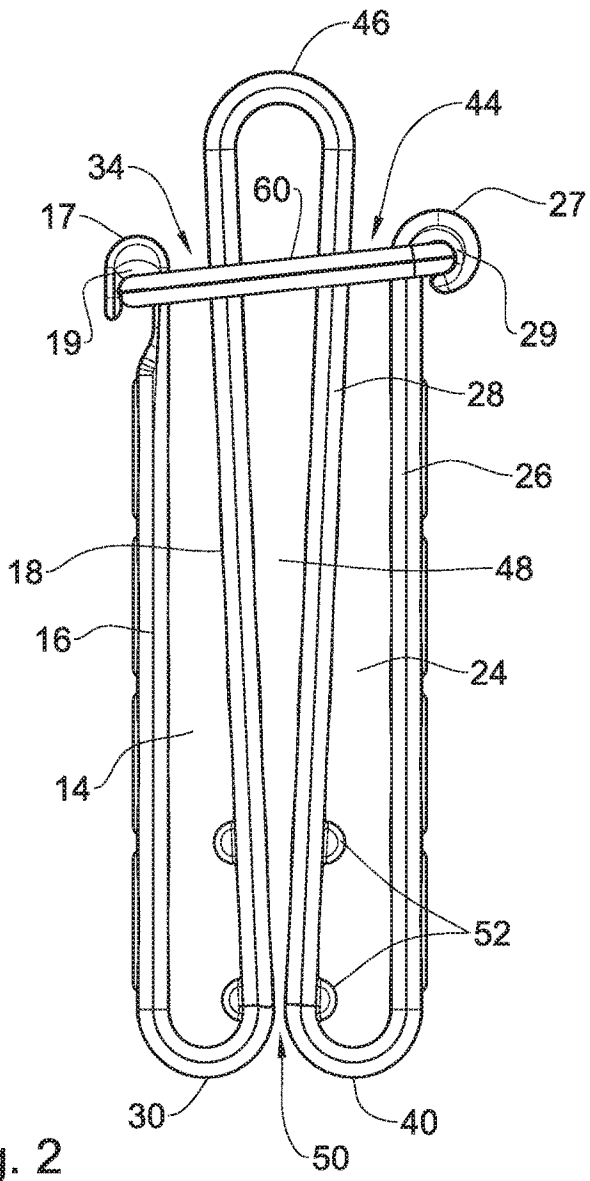
FIG. 2 illustrates the device of FIG. 1 at a closed position.

A closure mechanism is provided, in the form of an elastic band 60 (e.g. made of silicone rubber) secured within the looped eye 29 of the free end 27, configured for elastically stretch and engage with a respective arresting loop 19 of the free end 17, as illustrated in FIG. 2. It is appreciated, as can be seen in FIG. 2, that stretching the elastic band 60 into the closed position results in slight deformation of the elongate members, in particular the first external elongate member 16 and the second external elongate member 26, so as to increase clamping of any garments received within the respective first and second elongate garment receiving recess 14, 24. Once the closure member, namely band 60, is displaced into the closed position, it simultaneously closes both the first and second garment opening 34, 44.

In the position of FIGS. 1A and 1B the device 10 is at its open position, suspended by closure band 60 over a hanging member 66. It should be appreciated that hanging member 66 can be many different elements such that the garment handling device 10 can be used at different locations and modes. For example, it can be suspended at its open position over any sort of hook, e.g. a door hook 66 as in the example (where it suspends from a top edge of a cupboard door; not shown), or a wall hook, or a suction cup hook, etc., rendering the device readily available for introducing garments into the garment receiving recess 14, 24, wherein the garments can be sorted (e.g. paired by size, color, belonging, etc.), wherein after the device can be closed by the closure band 60 (FIGS. 2 and 8) and directly introduced into a laundry machine. Likewise, the device can be used for storing the garments after a laundering cycle, wherein the garments can be directly collected for use from the suspended device 10.

Figure 3:
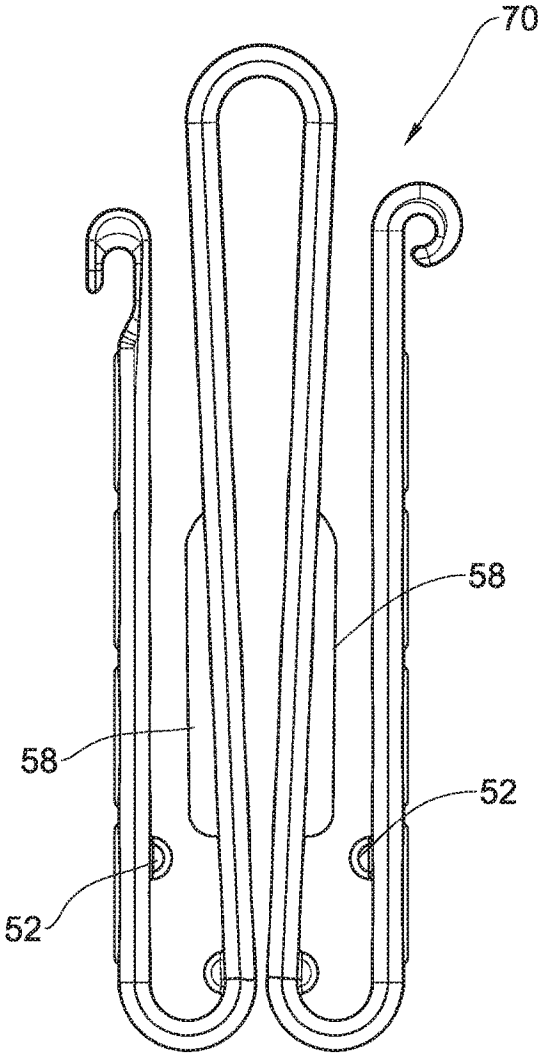
FIG. 3 is a modification of a retention arrangement applied to a garment handling device of the disclosure.

It is appreciated that other forms of retention projections can be configured, e.g. ribs 58 illustrated in the garment handling device 70 seen in FIG. 3, cooperating with bulges 52 extending from an opposite facing elongate member.

The idea is that the device according to the disclosure can be used throughout a laundering cycle, i.e. garments can be sorted/paired and placed in the device for washing (e.g. socks can be removed after wearing and directly be placed in the device), whilst the device is suspended at the open position. Once ready for laundry, the device is closed, using the closure mechanism, and the device with the garments accommodated therein is introduced into a washing machine, after which it can be introduced into a dryer (e.g. tumble drier) or be hung for drying, without having to remove the garments. The device with the clean garments can then be placed in any storage unit, e.g. drawer, or be suspended.

The device is made of material/s that are durable and resistant to detergents and UV, so as to withstand a plurality of laundering cycles.

Figure 4C:
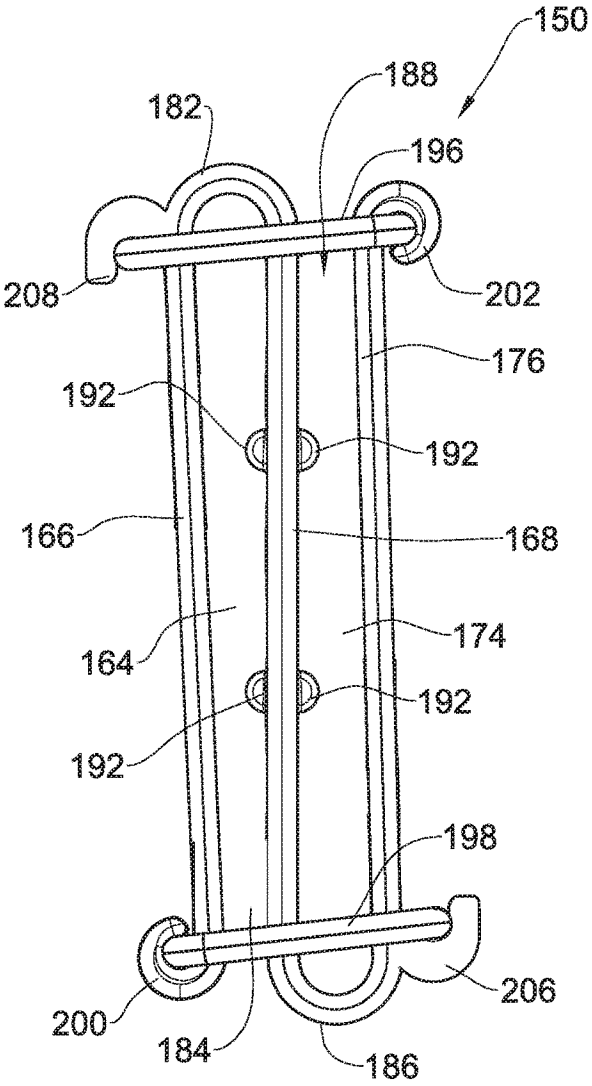
FIGS. 4A to 4C are different embodiments of a garment handling device according to the present disclosure.
Figure 4B:
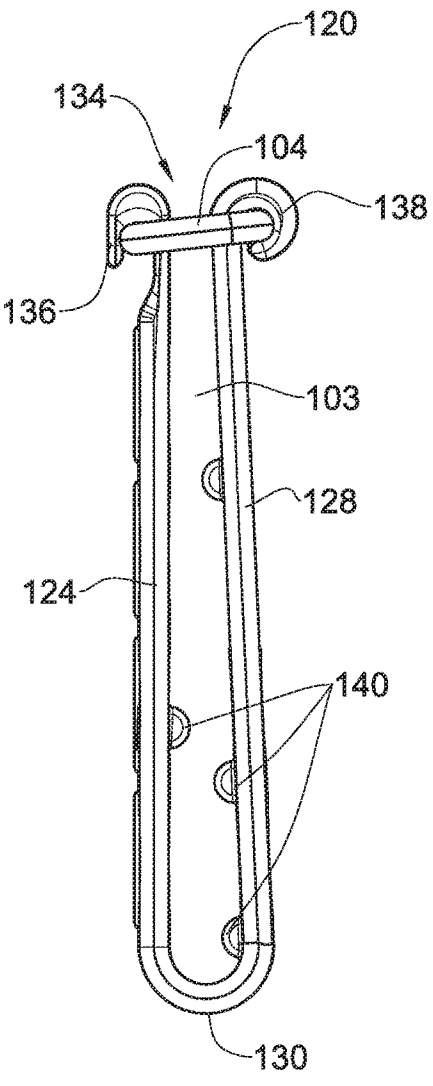
Figure 4A:
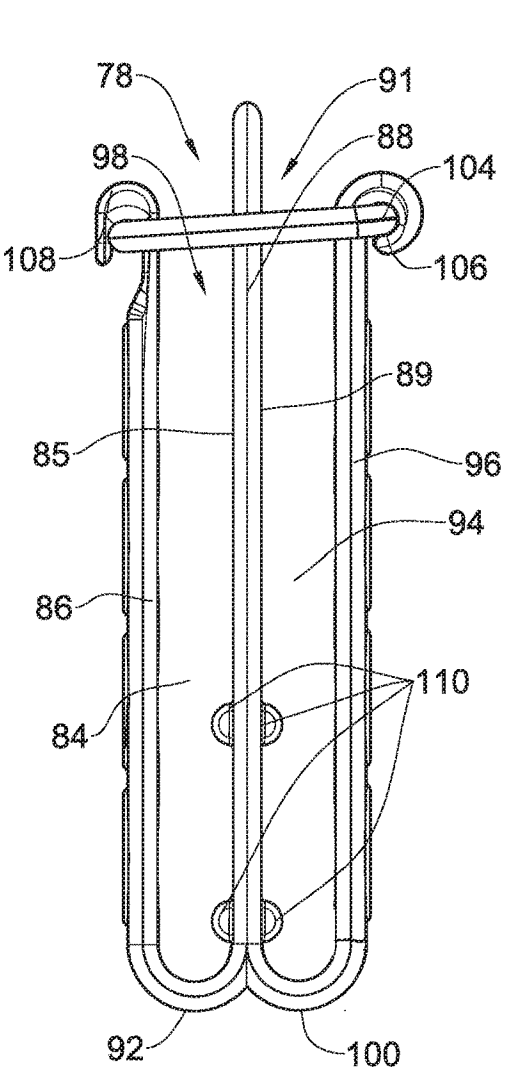

FIGS. 4A to 4C illustrate examples of modifications of garment handling devices according to the disclosure. Operation and use of the garment handling devices illustrated herein after is similar to that as with the device 10, as discussed herein above. In the illustrated examples, the respective elongate members are flat, and are each configured with several openings, provided for increasing air flow and improving drying of any garments accommodated within the garment receiving recesses, and likewise improve penetration of washing liquids. It is appreciated that other forms and shapes of openings can be configured, and can be differently distributed over the elongate members (not shown).

In FIG. 4A there is a garment handling device generally designated 78, also made of a uniform, rigid plastic material, and generally having a closed W-like shape, i.e. comprising a first elongate garment receiving recess 84 extending between a first external elongate member 86 and a first face 85 of neighboring inside elongate member 88, and a second elongate garment receiving recess 94 extending between a second external elongate member 96 and a second face 89 of said inside elongate member 88, wherein the first external elongate member 86 and the inside elongate member 88 continuously extend at their respective bottom end 92, and are configured with a first garment opening 98 at their respective opposite top end. Likewise, the second external elongate member 96 and the inside elongate member 88 continuously extend at their respective bottom end 100 and are configured with a second garment opening 91 at their respective opposite top end.

Similar to the previous example, there is provided a closure mechanism is provided, in the form of an elastic band 104 secured within the looped eye 106 at the free top end of the second external elongate member 96 and is configured for engaging with a respective arresting loop 108 at the top free end of the first external elongate member 86, as illustrated in FIG. 4A. The device 78 is further configured with several garment retention projections, in the form of bulges 110 extending from an inside face of the inside elongate member 88, and projecting into the garment receiving recess 84, 94.

In FIG. 4B there is illustrated yet another example of a garment handling device according to the disclosure, generally designated 120. The device is also made of a uniform, rigid plastic material, and generally has an U-like shape. The device comprises a single elongate garment receiving recess 134 extending between a first elongate member 126 and a second elongate member 128, continuously extending at their respective bottom end 130 and configured with a garment opening 134 at the respective opposite top end.

Here too, there is provided a closure mechanism is provided, in the form of an elastic band 104, shown in solid line at its closed position and in dashed lines at its open, suspended position. The elastic band 104 is secured within a looped eye 136 at the free top end of the first elongate member 124 and is configured for elastically stretching and engaging with a respective arresting loop 138 at the top free end of the second elongate member 128. Several garment retention projections, in the form of bulges 140 extending from an inside face of the elongate members 124, 128, and projecting into the garment receiving recess 134.

Turning now to FIG. 4C, the garment handling device 150 has a generally S-like shape made of a uniform, rigid plastic material. The device 150 comprises a first elongate garment receiving recess 164 extending between a first external elongate member 166 and a common inside elongate member 168, and a second elongate garment receiving recess 174 extending between a second external elongate member 176 and said inside elongate member 168, wherein the first external elongate member 166 and the inside elongate member 168 continuously extend at their respective top end 182 and are configured with a first garment opening 184 at their respective opposite bottom end. Likewise, the second external elongate member 176 and the common inside elongate member 168 continuously extend at their respective bottom end 186 and are configured with a second garment opening 188 at their respective opposite top end.

The first garment receiving recess 164 and the second garment receiving recess 174 are each configured with several garment retention projections, in the form of bulges 192 extending from a face of the inside elongate members 168 and projecting into the garment receiving recess 164, 174.

Two closure elastic bands are provided, one configured for closing the first garment opening 184, and the other configured for closing the second garment opening 188. Each of the bands 196 and 198 is secured at a respective looped eye 200, 202, and is configured for elastically stretching and engaging with a respective arresting loop 206, 208, said bands operate similar as discussed in connection with previous examples, i.e. operate so as to increase clamping of any garments received within the respective elongate garment receiving recesses 164, 174, and optionally for hanging the device with at least one of the garment receiving recesses 164, 174 at its respective open position.

Figure 5:
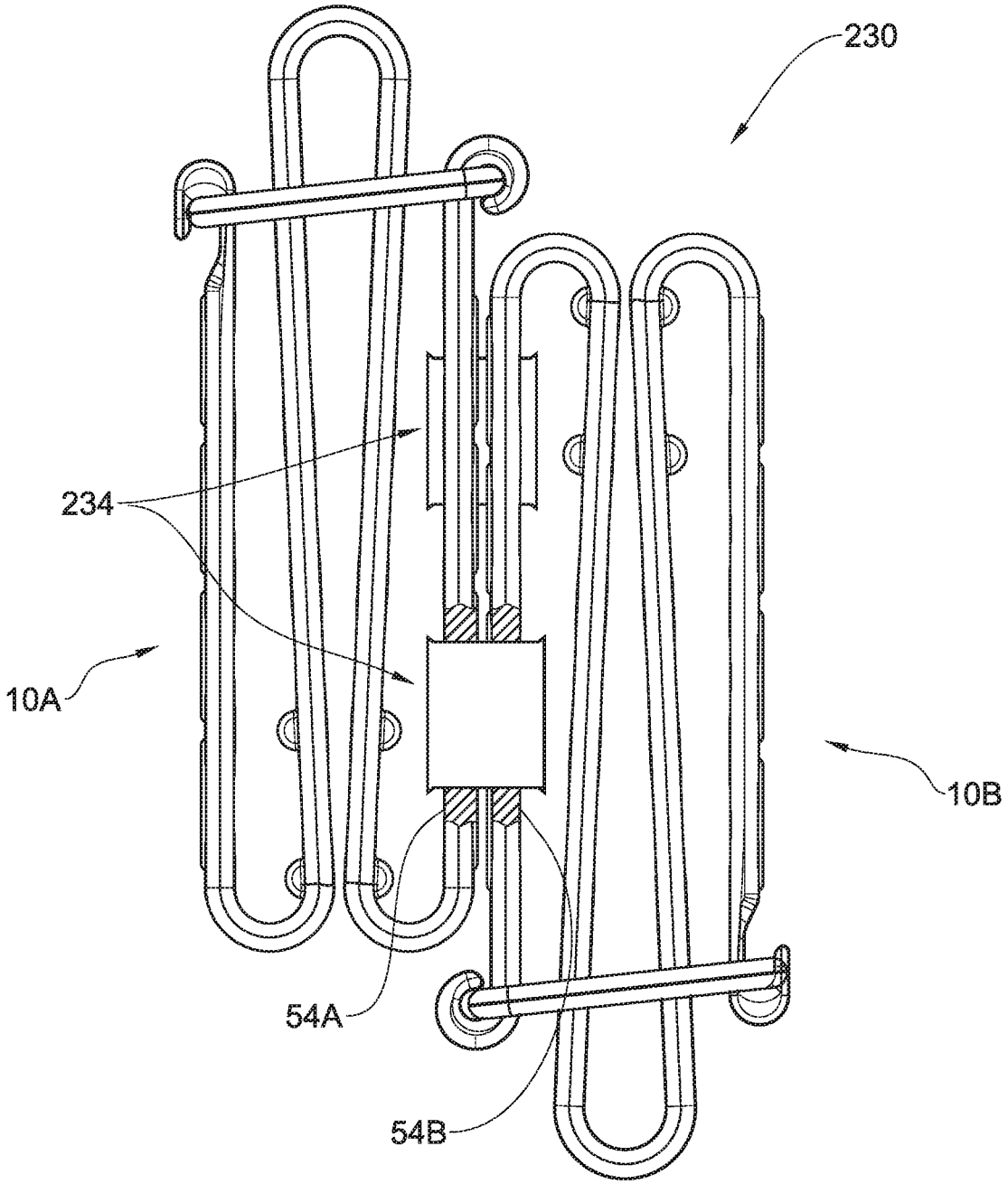
FIG. 5 illustrates how two garment handling devices of the disclosure can be articulated to one another.

Turning now to FIG. 5 of the drawings, there is illustrated a garment handling assembly generally designated 230 comprising two garment handling devices 10A and 10B of the type discussed hereinabove in connection with the first example of FIGS. 1 and 2. The two garment handling devices 10A and 10B are same devices disposed at upside down orientation, and articulated to one another by a pair of coupling members 234 configured for snap engagement within the respective mating openings 54A and 54B. This arrangement provides multiplied garment accommodating space whilst the assembled device 230 can be used as a whole throughout a laundering cycle, or the two garment handling devices 10A and 10B can be separated at any desired time. Additional garment handling devices can be articulated to one another, as desired, wherein the devices not necessarily have to be identical, but rather be configured with corresponding openings.

Figure 6:
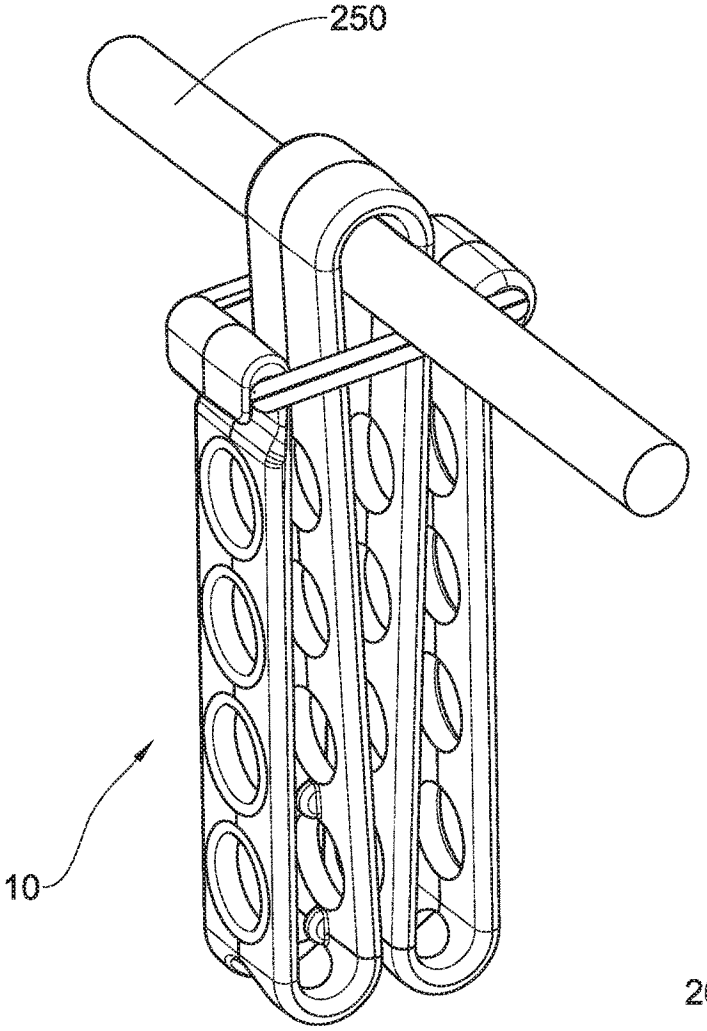
FIG. 6 illustrates how a garment handling device is applied over a laundry drying line.

FIG. 6 illustrates the garment handling device 10, according to the example discussed herein above, mounted over a drying line 250 and secured in place by means of the closure mechanism, namely the elastic band 60, which prevents the device 10 from detaching and simultaneously secures the garments in place (garments not shown).

Figure 7:
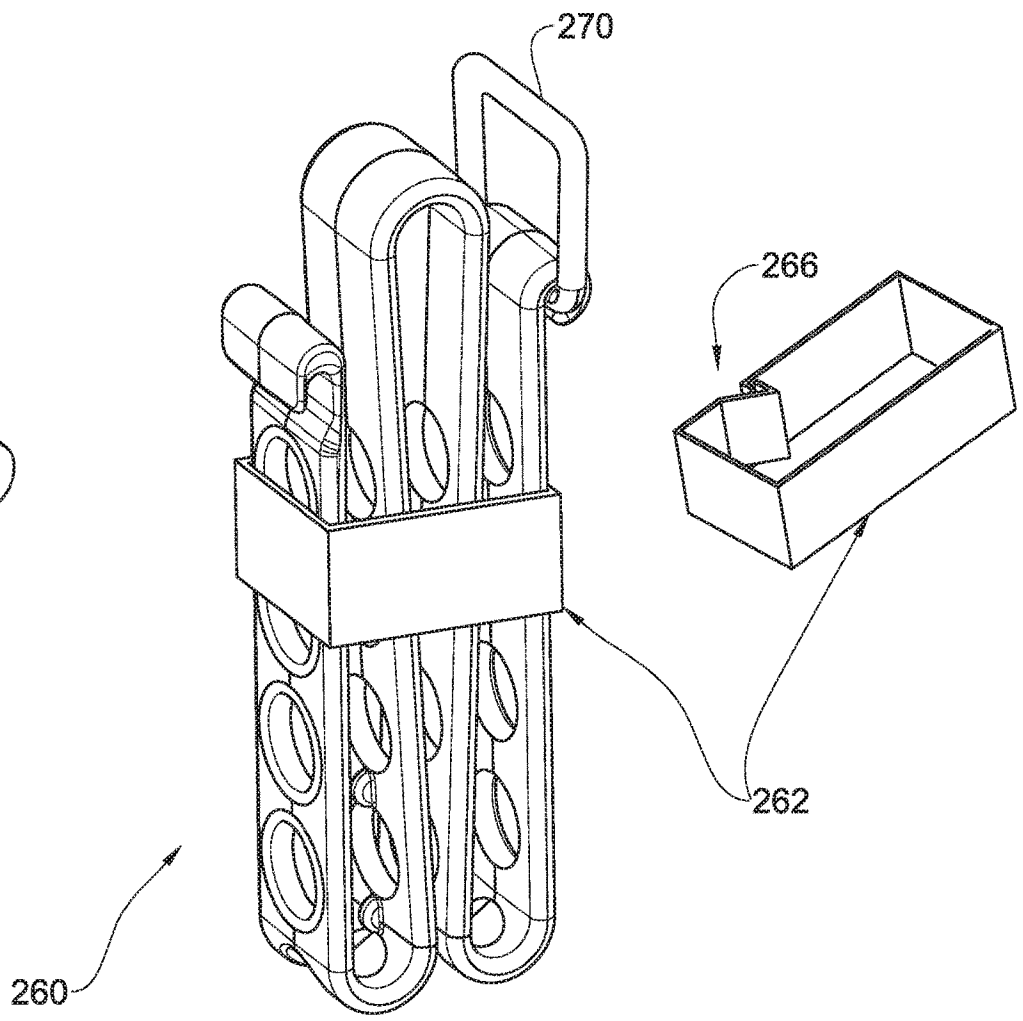
FIG. 7 illustrates a garment handling device configured with a different closure mechanism.

FIG. 7 illustrates a garment handling device 260 similar to device 10 discussed herein before, however further configured with a closure mechanism 262 designed as a rectangular clamping brace member, configured with a clamping closure 266. The garment handling device 260 is further provided with a hanging loop 270.

Figure 8:
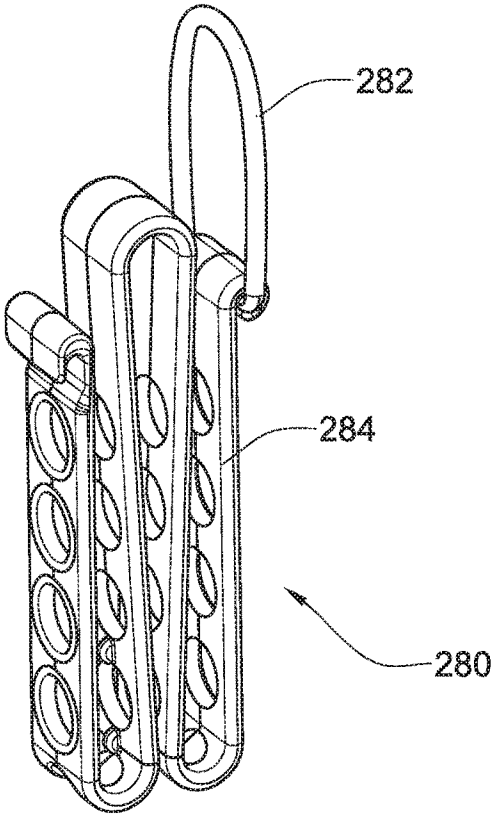
FIG. 8 illustrates another embodiment of a garment handling device, wherein the elongate members are uniformly and integrally formed with one another and with the closure mechanism.

In FIG. 8 there is illustrated a garment handling device 280 similar to device 10, however wherein a closure mechanism 282 is integrally formed with one of the external elongate member 284 and extends from its top end. According to this arrangement, the device is a tow component molding, wherein the elongate members are made of rigid material, and the closure mechanism 282 is a resilient, elastic material, e.g. silicone rubber. Likewise, other portions of the device can be made of, and/or coated with said resilient material, thus imparting edges of the device with a cushioning.

Figure 9:
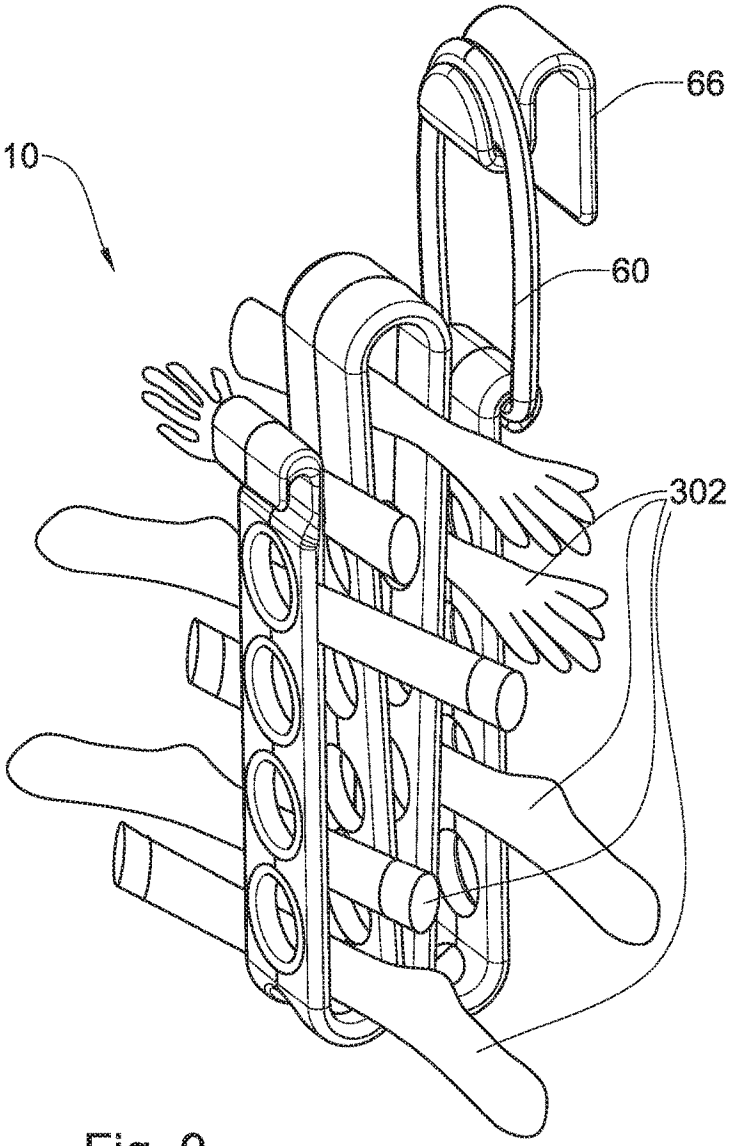
FIG. 9 illustrates a suspended garment handling device according to the disclosure, accommodating a plurality of garments.

Turning to FIG. 9 there is illustrated the garment handling device 10, according to the first example of the disclosure, accommodating a plurality of garments (collectively designated 302), the device 10 being at its so-called open position, i.e. with the closure band 60 suspended form a hook 66.

The invention claimed is:

1. A garment handling device, comprising:

a first elongate garment receiving recess extending between a first elongate member and a second elongate member, wherein the first and the second elongate member are made of rigid material and articulated to one another at one end, and configured with a garment opening at a respective opposite end;

a second elongate garment receiving recess extending between said second elongate member and a third neighboring elongate member, wherein said second and third elongate members are made of rigid material and articulated to one another at one end, and configured with a second garment opening at their respective opposite end, wherein one or more of the elongate members are flat members; and wherein one or more of the flat elongate members include one or more through going openings, for improving air flow and liquid access to garments received within the first elongate garment receiving recess and/or the second elongate garment receiving recess.

2. The garment handling device of claim 1, further comprising a closure mechanism for closing the garment opening, said garment handling device configured between an open position in which said garment opening is open, and a closed position which said garment opening is closed.

3. The garment handling device of claim 2, wherein at the open position, the garment opening is open, thus facilitating introducing and/or removing one or more garments into and/or from the at least one elongate garment receiving recess, whilst at the closed position the garment opening is closed.

4. The garment handling device of claim 2, wherein closing the closure mechanism results in the respective open end of the two neighboring elongate members to deform so as to decrease the garment receiving recess, thereby clamping therebetween one or more garments introduced therein.

5. The garment handling device of claim 2, wherein the closure mechanism includes a clamping closure extending over the two neighboring elongate members and tending to decrease a space of the at least one elongate garment receiving recess.

6. The garment handling device of claim 2, wherein the two neighboring elongate members are uniformly and integrally formed with one another and with the closure mechanism.

7. The garment handling device of claim 1, wherein the garment handling device has an S-like shape configured with two garment receiving recesses, having a garment opening opposite ends.

8. The garment handling device of claim 1, wherein the garment handling device has a W-like shape and is accordingly configured with two or three garment receiving recesses, two of which having a garment opening facing in a same direction and one at an opposite direction.

9. The garment handling device of claim 1, being a solid, uniform unit, wherein the two neighboring elongate members are continuous with one another.

10. The garment handling device of claim 1, wherein the two neighboring elongate members are integrally articulated to one another through a living hinge, and wherein the two neighboring elongate members are pivotable about said living hinge to allow complete access to the garment receiving recesses.

11. The garment handling device of claim 1, wherein the garment receiving recesses is configured with a garment retention arrangement.

* * * * *